United States Patent [19]

Lane

[11] 4,253,357

[45] Mar. 3, 1981

[54] SCREWDRIVER ACCESSORY

[76] Inventor: Don W. Lane, 8307 Leghorn St., Houston, Tex. 77040

[21] Appl. No.: 44,084

[22] Filed: May 31, 1979

[51] Int. Cl.[3] ..... B25B 13/58

[52] U.S. Cl. ..... 81/180 R

[58] Field of Search ..... 81/180 R; 145/50 R; 46/48, 50, 64

[56] References Cited

U.S. PATENT DOCUMENTS

| | | | |
|---|---|---|---|
| 1,261,854 | 4/1918 | Reynders | 46/64 |
| 1,262,061 | 4/1918 | Kristofek | 46/64 |
| 2,670,427 | 2/1954 | Barlet et al. | 145/50 R X |
| 2,674,685 | 4/1954 | Young | 145/50 R X |

FOREIGN PATENT DOCUMENTS

| | | | |
|---|---|---|---|
| 815285 | 6/1959 | United Kingdom | 145/50 R |

*Primary Examiner*—James G. Smith

*Attorney, Agent, or Firm*—Gunn, Lee & Jackson

[57] ABSTRACT

A screwdriver accessory is disclosed, the preferred embodiment incorporating a central rubber grommet having an axial passage therethrough, the axial passage frictionally gripping the shaft of a screwdriver. It is surrounded by a disk of polished metal. In an alternate form, the axial passage through the rubber grommet is made rectangular to fit around the spade of a screwdriver. It is also constructed with a multilayered disk, an alternate additional layer protecting the lip and periphery against damage.

5 Claims, 5 Drawing Figures

SCREWDRIVER ACCESSORY

BACKGROUND OF THE DISCLOSURE

In using a screwdriver or nut driver, a very troublesome problem occurs. The problem primarily relates to visibility for the user. Screwdrivers and nut drivers are provided with shafts of all lengths. The problem typically arises in the use of a long screwdriver to operate in confined or close quarters. In working under the hood of an automobile, it is often necessary to use long screwdrivers to reach a nut, bolt or screw at a very remote location. It typically occurs at a location which is poorly lighted. Even in bright, outdoor sunlight, the working area beneath the hood of an automobile is sometimes terribly obscured by a lack of good illumination. Sometimes, illumination is available, but the mechanic or serviceman will not be able to position his head so that he can have unobscured line-of-sight view of the work area. The view might be clear until the mechanic places his hand and tool in the only position available which then blocks his view.

The present invention is an apparatus which helps a mechanic position a screwdriver or nut driver in a remote location. It helps in several regards. First of all, it helps by reflecting additional light to the work area. In addition, it helps by reflecting an image for the user. As an example, in doing automobile work, it may be necessary to reach beneath some portion of the automobile and insert the screwdriver upwardly. In this circumstance, the user may not have adequate clearance to get his head beneath the automobile to look at it. The present invention provides a reflected view of the tip of the screwdriver or nut driver and thereby facilitates its use and operation. It is possible, but, in most instances, rather difficult to manipulate a screwdriver in a blind fashion. The present invention may, therefore, be summarized as an apparatus which is affixed to a screwdriver or nut driver as an accessory for the purpose of enhancing and improving illumination. It is a passive device not interfering in the ordinary use and operation of the screwdriver or nut driver. It does not modify or alter the manner in which hand tools function. However, it functions as circumstances permit to improve either the illumination or the view of the work area. In both instances, the work of the user is expedited.

DETAILED DESCRIPTION OF THE ILLUSTRATED EMBODIMENT

Figure 1:
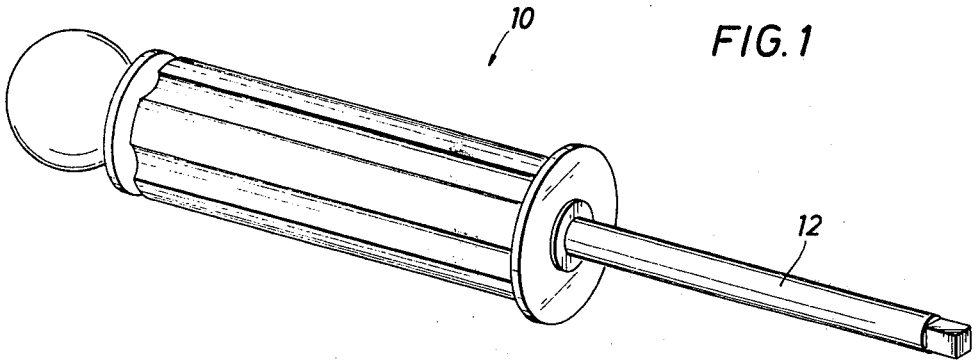
FIG. 1 shows the screwdriver accessory of the present invention installed on the shank of a typical nut driver.
Figure 2:
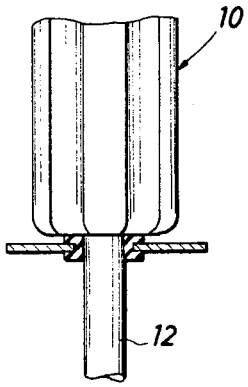
FIG. 2 is an enlarged view showing the mode of installation of the present invention on the shank of the nut driver shown in FIG. 1.

In FIG. 1 of the drawings, the numeral 10 identifies a nut driver which is support structure for the present invention. The present invention is installed on a nut driver or screwdriver, and the particular nut driver shown at 10 sets forth a typical installation. The nut driver includes a handle and shaft 12 which is typically round and has a length which is scaled to meet the needs of the user. The shaft 12 can be long or short. Normally, its diameter is varied depending on the scale of the nut driver. It terminates in a square or hex drive for sockets operated by the nut driver. As will be appreciated, the invention can also be installed on the shaft of a screwdriver. A screwdriver differs in that it has a flattened spade at the bottom tip, the spade typically terminating in a transverse edge. The present invention is suitably installed on a nut driver or a screwdriver. The nut driver 10 shown in FIG. 1 is merely representative of the apparatus on which the present invention can be installed and is subject to variation in detail and scale.

Figure 3:
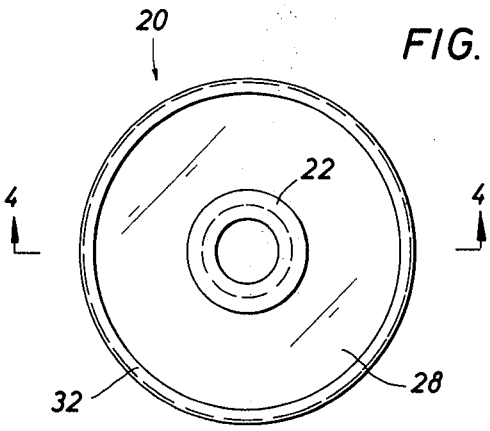
FIG. 3 is a plan view of the screwdriver accessory of the present invention.
Figure 4:
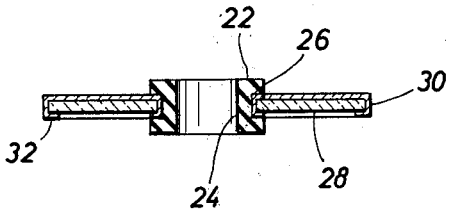
FIG. 4 is a sectional view through the apparatus shown in FIG. 3 illustrating details of construction.

The apparatus of the present invention is better understood by referring to FIGS. 3 and 4, to be considered jointly. The screwdriver accessory 20 in FIG. 3 incorporates a central rubber grommet 22 axially drilled at 24. The passage 24 has a length and diameter which enables it to fit snugly around the shaft or shank of a screwdriver or nut driver. The grommet 22 has a length sufficient to place an adequate surface area in contact with the shaft or shank of the screwdriver or nut driver. This surface area at 24 is ideally a resilient or rubber-like material which frictionally grips and holds the reflector 20 in position. Preferably, the passage 24 is sized to enable the reflector to slide up and down the shaft or shank with some frictional drag. As it is pushed along, the drag is sufficient to retain it at the achieved location. To this end, the opening 24 through the grommet must be sized or scaled for the screwdriver or nut driver. The present invention is, therefore, preferably made in several different sizes with grommets having several different size passages in them. As these sizes vary, the grommet also will vary to enable the present invention, when supplied in multiple quantities, to fit on many different sizes and shapes of screwdrivers and nut drivers.

The grommet 22 terminates in parallel planar faces on opposite sides. They can have other shapes, but the preferred embodiment is preferably a neat, compact structure of this type. The grommet 22 has a peripheral, external groove 26 formed in it which cuts into the central portion and forms an encircling notch or slot enabling it to receive a reflector disk 28. The disk 28 inserts into the notch or slot for clamping purposes and is affixed in this manner. The reflector disk 28 is preferably made of shatterproof material; the preferred material is polished metal such as a plated metal disk. Preferably, the plating is the sort of plating which accepts polishing to increase it reflectivity. The disk 28 can also be formed of shatterproof materials such as silvered glass. Silvered glass is ordinarily dangerous because it is frangible. However, reflective or silvered glass of a nonbreakable variety is available and can be used in the alternative in lieu of a metal disk as depicted in FIG. 4.

The present invention incorporates a surface covering 30 which covers the back side of the disk 28 and extends to the edge, wrapping around the disk. The covering 30 overhangs to form a slight protective lip 32 for isolating and shielding the disk 28. The lip is valuable in that it protects against smuding, dirt and the like.

The apparatus shown in FIGS. 3 and 4 is installed on a screwdriver by sliding it along the shaft or shank to a specified location. Preferably, the grommet 22 with the axial passage 24 is sized to fit around the shaft or shank of the screwdriver. The accessory 20 is moved by hand and has sufficient friction in its contact with the shaft or shank to maintain a position. This prevents it from dropping off the screwdriver when the screwdriver is held in the vertical position.

Figure 5:
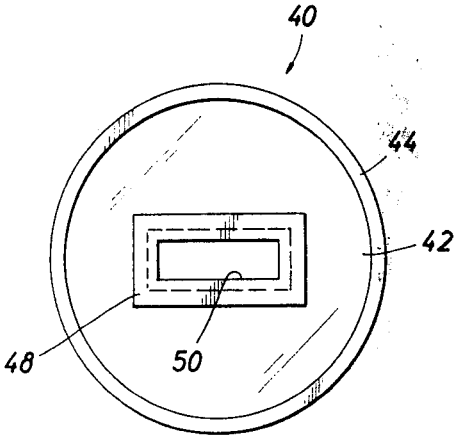
FIG. 5 is an alternate embodiment of the present invention which has been modified to be positioned on the spade of a screwdriver.

Attention is next directed to FIG. 5 of the drawings, where an alternate embodiment 40 is shown including a disk 42 which is constructed in the same fashion as the disk 28. It is provided with a polished or silvered face or surface to operate as a reflector and is enclosed in a protective covering 44 which covers the back face and wraps around the edge at 44. It overhangs slightly to encompass the encircled reflective area. The embodiment 40, however, differs in a significant regard in that it includes a central rubber insert 48 provided with a rectangular passage 50 through it. In contrast with the embodiment 20 which fits around the round shaft or shank of a screwdriver or nut driver, the slot 50 is rectangular for fitting about the spade on the tip of a screwdriver. The insert 48 is thus formed of rubber or some other resilient material which has a gripping action in the same fashion as the grommet 22. The dimensions of the slot 50 thus differ from the cylindrical passage 28 through the grommet 22, but, in other regards, the insert 48 resembles the grommet 22. It is constructed with an external groove around the insert 48 for fitting snugly in a mating rectangular slot in the disk 42. The embodiment 40 is installed by slipping it over the end of a screwdriver spade.

In operation, the embodiments 20 and 40 function in the same manner. That is to say, they are installed on a screwdriver or nut driver at some suitable location along the length. Once installed, they can be moved to the designated location along the length. Thereafter, readjustment is easily made. The apparatus is used in a very convenient fashion. The mode of use is nearly automatic for the mechanic because it requires a minimum of preliminary activity. Once installed, the reflectors 20 and 40 are easily used. The mechanic can utilize the reflectors 20 and 40 by positioning a light in a nearby location to reflect off of them to illuminate the work area. Alternatively, the screwdriver or nut driver can be positioned in its use to guide the screwdriver spade or tip to the desired location in the work by viewing the tip of the screwdriver or nut driver through the reflector. Such use is achieved in a routine fashion, and, to this end, the apparatus 20 or 40, once installed, can be left on the equipment indefinitely. Dependent on resiliency and thickness of the rubber grommet, it is possible to apply thumb pressure to the back side of the disk and press it to a desired angle. This angle may be quite different from the illustrated perpendicular posture of the disk shown in the drawings. This increases flexibility of the apparatus.

Because the present invention can be formed in many sizes and scales, it functions quite nicely for the intended purpose for all types of screwdrivers and nut drivers.

While the foregoing is directed to the preferred embodiments of the present invention, the scope thereof is determined by the claims which follow.

I claim:

1. For cooperative use with a screwdriver or nut driver of the type wherein a shaft portion extends from a handle portion, the improvement which comprises:

(a) a reflective disk having a face portion sufficiently reflective to enable light to be reflected thereby and further including a central opening formed therein; and (b) resilient gripping means installed in the central opening, said resilient gripping means having an opening sealed to and sized to fit about a portion of the shaft of the screwdriver or nut driver to hold said reflective disk face at a desired location along the shaft portion thereof.

2. The apparatus of claim 1 wherein said resilient means includes an external groove thereabout for locking against said reflective disk face.

3. The apparatus of claim 2 wherein said reflective disk face is defined by a surrounding, edge located, protective coating.

4. The apparatus of claim 2 wherein said resilient means has an opening which is circular.

5. The apparatus of claim 2 wherein said resilient means has an opening which is rectangular.

* * * * *